US007878266B2

(12) United States Patent
Griffin et al.

(10) Patent No.: US 7,878,266 B2
(45) Date of Patent: Feb. 1, 2011

(54) DOWNHOLE FORCE MEASUREMENT

(75) Inventors: Lawrence G. Griffin, Houston, TX (US); Randy Blackmon, La Porte, TX (US); Philippe Legrand, The Woodlands, TX (US); Glenn McColpin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 525 days.

(21) Appl. No.: 11/844,774

(22) Filed: Aug. 24, 2007

(65) Prior Publication Data

US 2009/0050368 A1 Feb. 26, 2009

(51) Int. Cl.
*E21B 47/01* (2006.01)

(52) U.S. Cl. ..... 175/40; 166/66; 73/152.48

(58) Field of Classification Search ..... 166/66; 175/27, 39, 40; 73/152.48, 152.49
See application file for complete search history.

(56) References Cited

U.S. PATENT DOCUMENTS 4,662,458 A 5/1987 Ho
6,924,745 B2 8/2005 Schultz et al.
2005/0257961 A1* 11/2005 Snell et al. ..... 175/40

OTHER PUBLICATIONS

Optimization of PDC Drill Bit Performance Utilizing High-Speed, Real-Time Downhole Data Acquired Under a Cooperative Research and Development Agreement, Roberts, et al., SPE/IADC Drilling Conference, Feb. 23-25, 2005, Paper No. 91782-MS.

* cited by examiner

*Primary Examiner*—Daniel P Stephenson
*Assistant Examiner*—Brad Harcourt
(74) *Attorney, Agent, or Firm*—Schwegman, Lundberg & Woessner, P.A.

(57) ABSTRACT

An apparatus for measuring forces acting on a tubing string within a wellbore, comprising a body including a central passage and an internal void radially offset from the central passage. End portions extending from the body each include an internal passage and an interface configured to detachably couple to the tubing string for conveyance within the wellbore. A clamp is detachably coupled to one end portion, and first sensors coupled to the clamp are configured to detect strain induced by forces acting on the tubing string. At least one second sensor coupled to the body is configured to detect pressure and temperature within the wellbore. A memory device coupled to the body within the internal void is configured to log measurements detected by the first and second sensors. An electrical power supply coupled to the body within the internal void is configured to provide electrical power to the memory device.

20 Claims, 5 Drawing Sheets

DOWNHOLE FORCE MEASUREMENT

BACKGROUND

U.S. Pat. No. 4,662,458 is directed towards interpreting measurement-while-drilling (MWD) data to predict the direction of advance of a drill bit and evaluate mechanical properties of formations encountered by the drill bit. Specifically, the '458 patent describes sensing devices provided to measure the weight-on-bit and torque of the bit, as well as shear forces and bending moments working on the bit. The sensing devices produce a set of downhole force-moment measurements which can be resolved by calculations to produce the complete loading at the bit. These calculations can then be used, through bottom hole assembly deformation analysis, to detect abnormal deviation tendencies, detect formation interface and lithology change, predict advance directions for the drill bit, and instantaneously adjust operating conditions to control drilling direction.

However, the '458 patent fails to provide for the measurement of downhole forces during downhole operations other than drilling. Those skilled in the art readily appreciate the vast difference between the tools and equipment employing during drilling versus those utilized during non-drilling operations. Moreover, operating conditions such as tension, compression, torque, acceleration, pressure and temperature can be quite different during non-drilling operations relative to those encountered during drilling operations. Additionally, the '458 patent only provides measurements of forces acting on the drill bit, and fails to describe measurements of forces acting on any other section of the drilling, working, or other string being utilized within an existing borehole. Further yet, the '458 patent fails to describe downhole measurements other than force measurements, and thus provides no suggestion regarding the measurement of acceleration, pressure or temperature, among other operating conditions and parameters, whether such measurements are in regard to the drill bit or any other section of the string. The '458 patent also fails to describe logging any downhole measurements of force or other operating conditions and parameters, but instead only describes the immediate transmission of measurement data to a receiver located at the wellbore surface.

DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
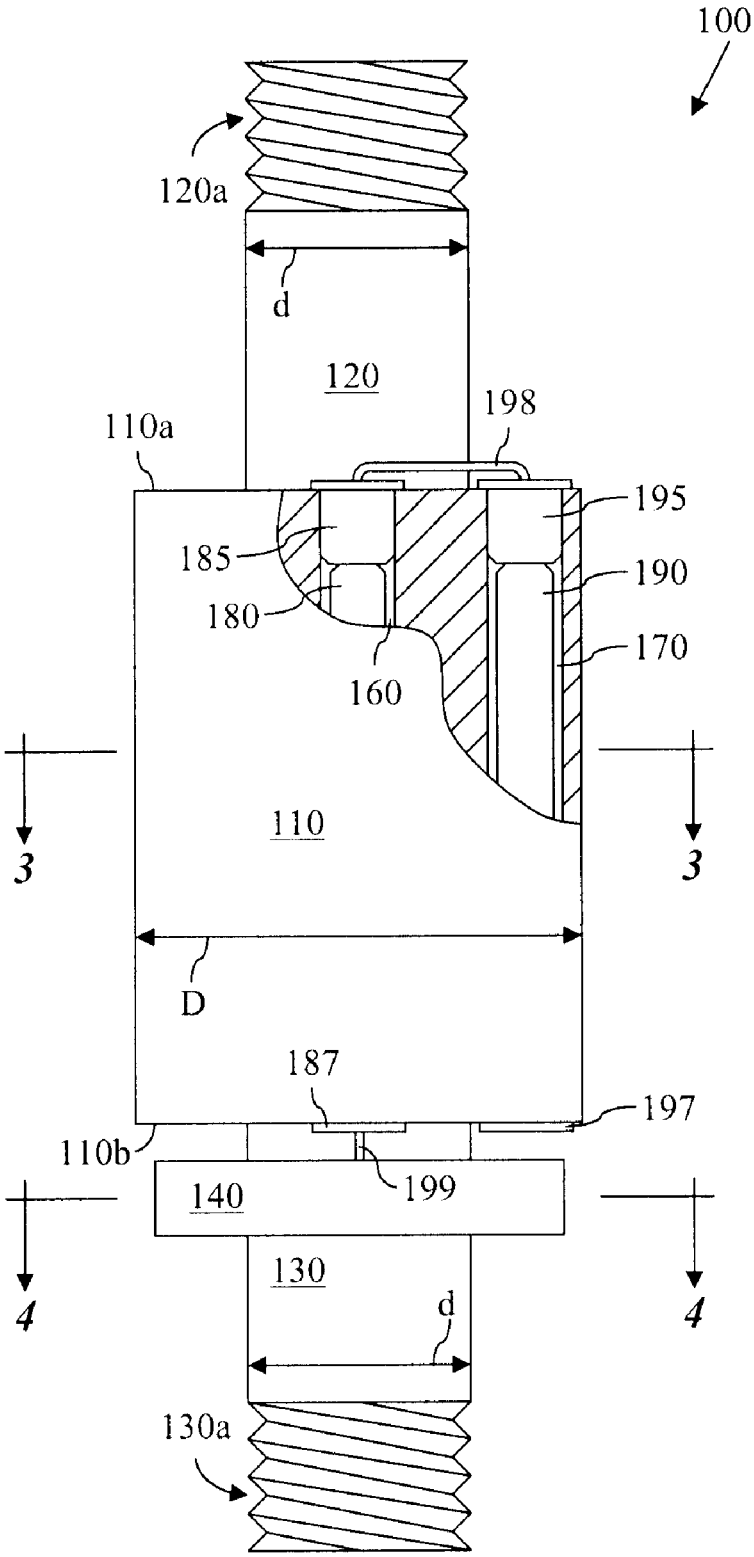
FIG. 1 is a side view, in partial section, of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is side view, in partial section, of an apparatus 100 according to one or more aspects of the present disclosure. The apparatus 100 is configured for measuring forces and other parameters at downhole locations in applications other than drilling applications, and with apparatus other than drilling apparatus. The apparatus 100 includes a body 110, an upper end portion 120, a lower end portion 130, and a sensor assembly 140.

In an exemplary embodiment, the end portions 120 and 130 may be integral to the body 110. That is, the body 110 and the end portions 120 and 130 may be manufactured from a single, discrete billet of metal or other material, such as by machining, casting, injection-molding, electro-discharge machining, and/or other manufacturing processes. Alternatively, one or both of the end portions 120 and 130 may be initially manufactured as a discrete component which is subsequently assembled to the body 110, such as by welding, threaded fasteners, and/or other assembly means.

The upper and lower end portions 120 and 130 may each be substantially cylindrical, possibly having an outer diameter "d" that is substantially less than an outer diameter "D" of the body 110. The upper and lower end portions 120 and 130 also include upper and lower interfaces 120*a* and 130*a*, respectively. The interfaces 120*a* and 130*a* are configured to detachably couple the apparatus 100 to or within a tubing string such that the apparatus 100 can be conveyed within a wellbore. Thus, for example, the interfaces 120*a* and 130*a* may comprise industry-standard pipe threads, although other interfaces are also within the scope of the present disclosure.

Figure 2:
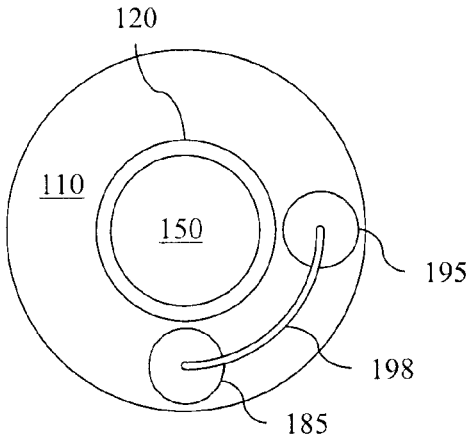
FIG. 2 is a top view of the apparatus shown in FIG. 1.
Figure 3:
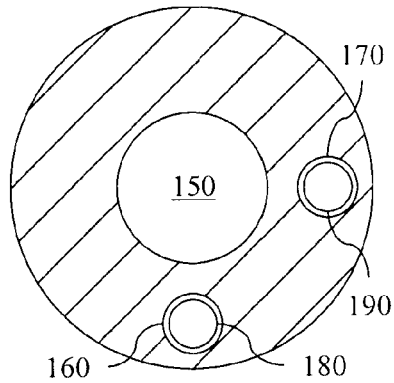
FIG. 3 is a sectional view of the apparatus shown in FIG. 1.

FIG. 2 is a top view of the apparatus 100, and FIG. 3 is a sectional view of the apparatus 100, as shown in FIG. 1. Referring to FIGS. 1-3, collectively, a central passage 150 extends through the upper end portion 120, the body 110, and the lower end portion 130. The central passage 150 may be composed of more than one aperture or, as depicted in the exemplary embodiment of FIGS. 1-3, the central passage 150 may be a single through-hole extending along the entire length of the apparatus 100. In either case, the central passage 150 is configured to align, engage, and/or otherwise cooperate with an internal passage of a tubing string to convey fluids and/or other materials along the tubing string.

The body 110 includes at least one elongated void extending along a substantial length of the body 110 in a position that is radially offset from the central passage 150. For example, in the exemplary embodiment shown in FIGS. 1-3, the body 110 includes elongated voids 160 and 170. The apparatus 100 also includes a memory device 180 and an electrical power supply 190, which may be received by and coupled within the elongated voids 160 and 170, respectively. Consequently, the elongated voids 160 and 170 may be sized and/or otherwise configured based on the size of the memory device 180 and power supply 190. The memory device 180 may be or comprise at least a memory portion of a Panex Model 3575 MRO, and the power supply 190 may be or comprise one or more lithium and/or other type of batteries.

The apparatus 100 may also include at least one plug fluidicly sealing one or more of the elongated voids. For example, in the exemplary embodiment shown in FIGS. 1-3, the memory device 180 and the power supply 190 are fluidicly isolated from the environment of the wellbore by detachable plugs 185 and 195, respectively, which each form a fluidic seal with the internal surface of the voids 160 and 170, respectively, and/or the end 110*a* of the body 110. The plugs 185 and 195 may each also be or comprise an electrical feed-through, thereby enabling electrical interconnection of the memory device 180, power supply 190, and/or other electrical components housed within the voids 160 and 170. Thus, for example, an electrical conductor 198 may interconnect the plugs 185 and 195. The electrical conductor 198 may comprise stainless or other steel tubing enclosing one or more wires, optical fibers, and/or other electrical signal conductors.

As the elongated voids 160 and 170 may extend along the entire length of the body 110, the apparatus 100 may include additional plugs fluidicly sealing the voids at the opposite end 110*b* of the body 110. For example, in the exemplary embodiment shown in FIGS. 1-3, fluidic isolation of the power supply 190 is completed by an additional detachable plug 197 forming a fluidic seal with the internal surface of the void 170 and/or the end 110*b* of the body 110. However, as most clearly depicted in FIG. 1, the plug 197 may not comprise an electrical feed-through, but may merely seal the end of the void 170. The lower end of the void 160, on the other hand, may be fluidicly sealed with an additional detachable plug 187 which does comprise an electrical feed-through. Accordingly, the memory device 180 fluidicly sealed within the void 160 can be electrically or otherwise communicably connected with the sensor assembly 140 via one or more conductors 199, which may be substantially similar to the conductor 198. Gauges, sensors and/or other measurement devices located within either or both of the voids 160 and 170 can have their memory downloaded by removing one or more of the plugs 185, 187, 195, 197, thereby providing access to a probe or other electrical connector through which the data can be retrieved.

In an exemplary embodiment, the void 160 comprises memory and power supply for performing motion and/or force sensing, measurement and/or logging in conjunction with sensors 142, whereas the void 170 comprises sensors, memory and power supply for performing pressure and/or temperature measurement and/or logging. In such an embodiment, as well as others within the scope of the present disclosure, the voids 160 and 170 may not be electrically interconnected, whether for power or communication.

For example, a power supply (e.g., one or more lithium batteries) coupled within the void 160 may be interconnected within the void 160 with corresponding circuit devices configured to receive and record data from sensors regarding forces acting on the apparatus 100, movement of the apparatus 100, and/or motion of the apparatus 100. Similarly, a power supply (e.g., one or more lithium batteries) coupled within the void 170 may be interconnected within the void 170 with corresponding sensors and circuit devices configured to detect pressure and/or temperature within the void 170, within the aperture 150, and/or within the wellbore environment surrounding the apparatus 100. In an exemplary embodiment, one of the voids 160 and 170 contains a PANEX strain gauge logging sensor with a lithium battery power supply, and the other of the voids 160 and 170 contains a PANEX model 3525AT or 3575MRO downhole digital quartz pressure and temperature logging device with a lithium battery power supply. In other embodiments, the electronic components of the apparatus 100 (within the voids 160 and 170 or otherwise) may be powered through smart pipe, downhole turbine, and/or other means.

Nonetheless, the scope of the present disclosure is not necessarily limited by the particular arrangement of the combination of power supply and/or metrology devices sealed within or connected to the one or more voids (e.g., voids 160 and 170) that are included within the apparatus 100. Thus, although at least one embodiment explicitly described herein includes memory components within the void 160 and power supply components within the void 170, such embodiment is only exemplary, and is provided merely for the sake of simplicity, such that those skilled in the art will readily understand that other embodiments are also within the scope of the present disclosure.

Figure 4:
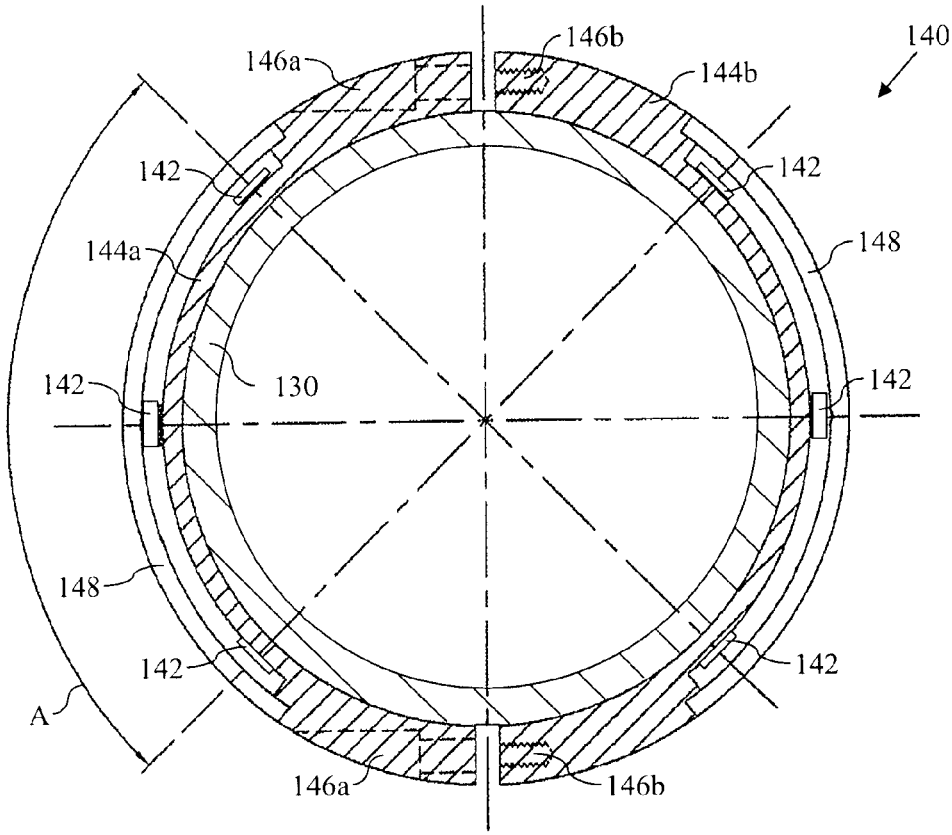
FIG. 4 is a sectional view of the apparatus shown in FIG. 1.

FIG. 4 is a sectional view of the apparatus 100, as shown in FIG. 1. Referring to FIGS. 1 and 4, collectively, the sensor assembly 140 includes a plurality of sensors 142 each configured to detect strain induced by forces acting on the tubing string. For example, the sensors 142 may each be or comprise one or more conventional or future-developed strain gages, including those commercially available from PANEX. In the exemplary embodiment shown in FIG. 4, the sensor assembly 140 includes six sensors 142. However, other embodiments within the scope of the present disclosure may include another number of sensors 142.

The sensor assembly 140 may also include a clamp subassembly comprising a first member 144*a* and a second member 144*b*, as well as a plurality of threaded fasteners (not shown) coupling the first and second members 144*a* and 144*b*. For example, as in the exemplary embodiment shown in FIG. 4, the first member 144*a* may include a plurality of counterbored apertures 146*a* through which threaded fasteners pass and engage threaded apertures 146*b* of the second member 144*b*. However, other means for coupling the first and second members 144*a* and 144*b* are also within the scope of the present disclosure. For example, the first and second members 144*a* and 144*b* may be hingedly coupled, or the entire assembly 140 may be threaded on to the lower end portion 130 or other portion of the apparatus 100. Further, the sensor assembly 140 may include a number of members other than the two members (144*a* and 144*b*) shown in the exemplary embodiment depicted in FIG. 4. In any case, however, the members of the sensor assembly 140 (e.g., 144*a* and 144*b*) may be configured to substantially encircle the perimeter of the second end portion 130 of the apparatus 100 such that the stress induced in the apparatus 100 by the tubing string can be detected by the sensors 142 of the sensor assembly 140.

Figure 5:
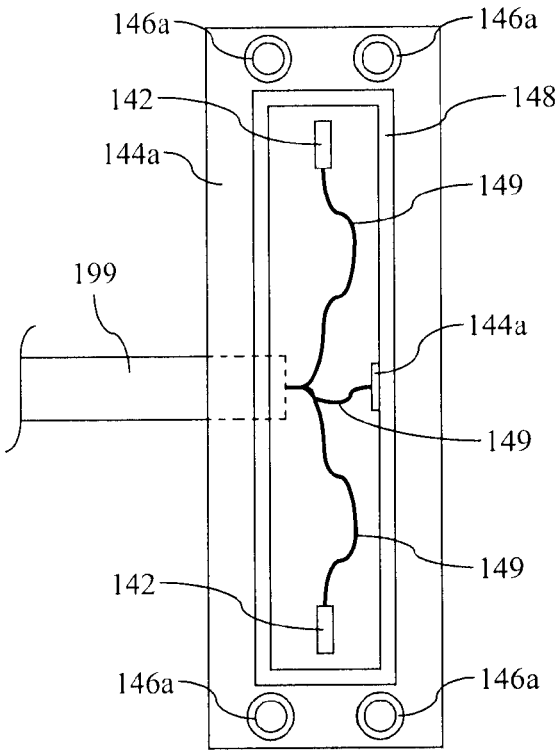
FIG. 5 is a side view of a portion of the apparatus shown in FIG. 1.

FIG. 5 is a side view of the first member 144*a*. Referring to FIGS. 4 and 5, collectively, each of the first and second members 144*a* and 144*b* may include one or more external recesses 148 to which the sensors 142 are coupled. For example, each recess 148 may be a stepped recess in which the depth at the perimeter of the recess 148 is less than the depth of the remainder of the recess 148. Two of the sensors 142 may be coupled to a sidewall of each of the recesses 148 at diametrically opposed locations, whereas the four remaining sensors 142 may be coupled to the bottom surfaces of the recesses 148 at angularly distributed positions. For example, the four remaining sensors 142 may be positioned at an angle "A" relative to one another, on opposing sides of the sensors 142 that are coupled to the sidewalls of the recesses 148. The angle "A" may be about 90°, as in the exemplary embodiment shown in FIG. 4, although other angles are also within the scope of the present disclosure. The sensors 142 may be coupled within the recesses 148 by adhesive, chemical bonding, and/or other means. Electrical wires and/or other conductive members 149 extend within the recesses 148 from each of the sensors 142 to the electrical conductor 199, which may extend into an aperture in the sidewall of the member 144*a*.

Figure 6:
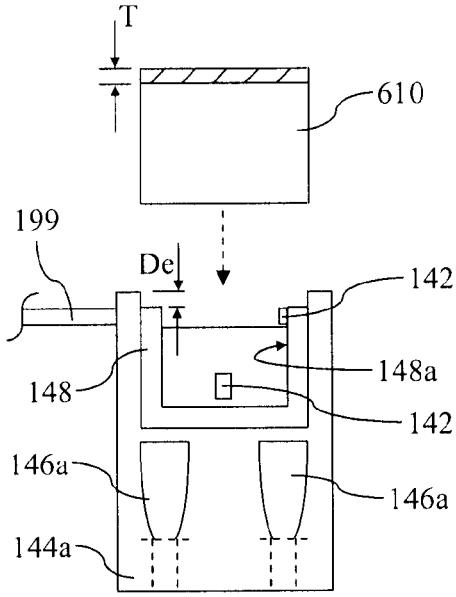
FIG. 6 is a partial sectional view of the apparatus shown in FIG. 5.

FIG. 6 is a partial sectional view of the first member 144*a* shown in FIG. 5, demonstrating the assembly of an optional cover plate 610 assembled into or over the recess 148 of the first member 144*a* (depicted by the dashed arrow). The cover plate 610 shields the sensors 142 and conductive members 149 from the ambient environment of the wellbore. For example, the cover plate 610 may provide a fluid tight seal with the recess 148 and/or external radius or other profile of the first member 144*a*, such as to isolate the sensors 142 and conductive members 149 from fluids existing within the wellbore. The cover plate 610 may additionally or alternatively protect the sensors 142 and conductive members 149 from impact or shock, such as may be encountered when conveying the apparatus 100 within the wellbore via the tubing string (e.g., tripping in or tripping out).

In an exemplary embodiment, the recess 148 is stepped so that it can include a sidewall 148*a* to which one or more of the sensors 142 can be attached, yet in a manner that the recess 148 can still receive the cover plate 610. For example, the thickness "T" of the cover plate 610 can be about equal to or less than the depth "De" of the first step of the recess 148.

The cover plate 610 may substantially comprise metallic materials, and may couple to the first member 144*a* via threaded fasteners, one or more clamps, interference fit, and/or other means (not shown). The external radius or other profile of the cover plate 610 may be substantially similar or identical to that of the first member 144*a*. Alternatively, the cover plate 610 may be recessed within the external radius or other profile of the cover plate 610. The apparatus 100 may also include an additional cover plate, coupled to the second member 144*b*, which may be substantially similar to the cover plate 610 shown in FIG. 6.

Figure 7:
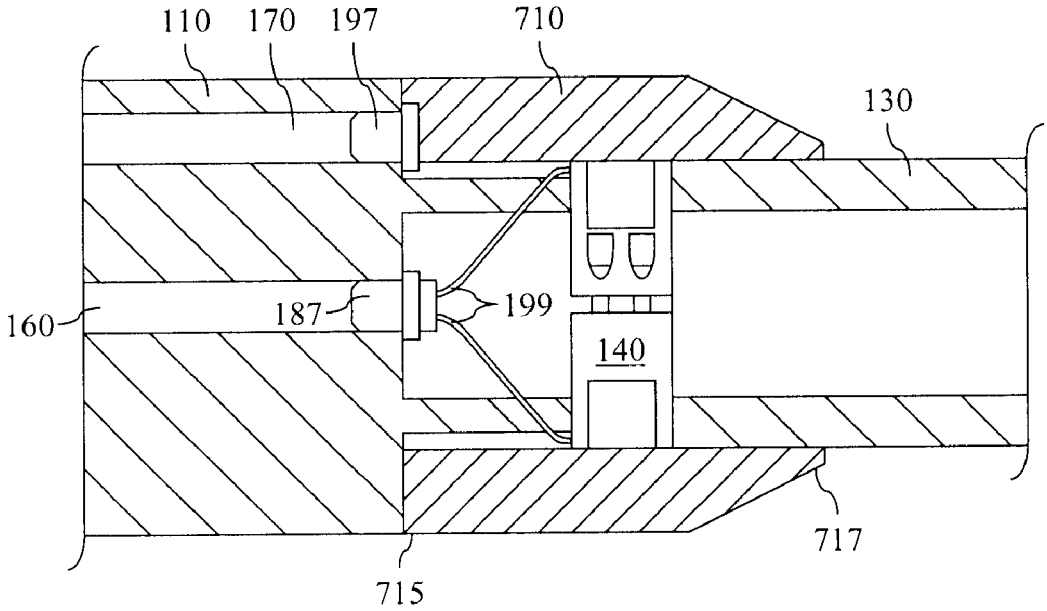
FIG. 7 is a partial sectional view of a portion of the apparatus shown in FIG. 1.

FIG. 7 is a partial sectional view of a portion of the apparatus 100 shown in FIG. 1, demonstrating the assembly of an optional bonnet 710 into the apparatus 100. The bonnet 710 shields the sensor assembly 140, the plugs 187 and 197, and the electrical conductor(s) 199 from the ambient environment of the wellbore. For example, the bonnet 710 may provide a fluid tight seal with the body 110 and/or the end portion 130, such as to isolate the sensor assembly 140, the plugs 187 and 197, the electrical conductor(s) 199, and/or other components of the apparatus 100 from fluids existing within the wellbore. The bonnet 710 may additionally or alternatively protect such components of the apparatus 100 from impact or shock, such as may be encountered when conveying the apparatus 100 within the wellbore via the tubing string.

The bonnet 710 may substantially comprise metallic materials, and may couple to the body 110 and/or the end portion 130 via a threaded coupling, threaded fasteners, one or more clamps, interference fit, and/or other means (not shown). At one end 715, the external diameter or other profile of the bonnet 710 may be substantially similar or identical to that of the body 110, whereas the other end 717 of the bonnet 710 may be tapered to or near the external diameter or other profile of the end portion 130, such as may facilitate conveyance of the apparatus 100 within the wellbore.

Figure 8:
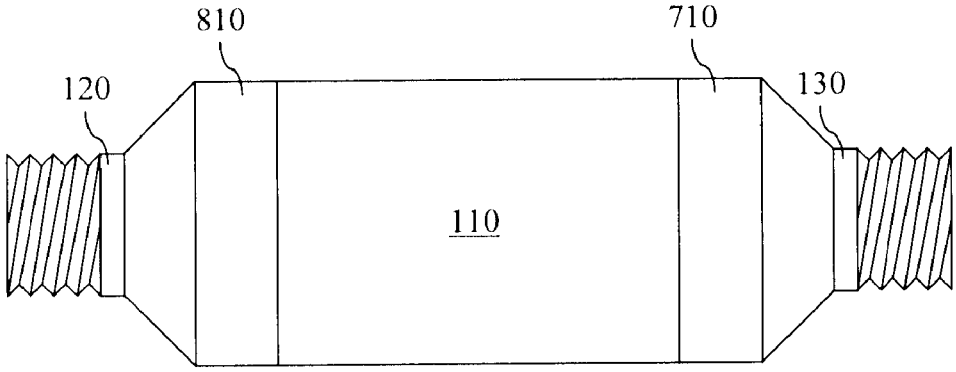
FIG. 8 is a side view of the apparatus shown in FIG. 1.

FIG. 8 is a side view of the apparatus 100 shown in FIG. 1 in an embodiment in which the bonnet 710 shown in FIG. 7 is assembled at one end of the body 110. FIG. 8 further demonstrates that the apparatus 100 may include an additional bonnet 810 at the opposite end of the body 110. The bonnet 810 may be substantially similar to the bonnet 710 shown in FIG. 7, and may be coupled to the body 110 and/or the end portion 120 in substantially the same manner as the assembly of the bonnet 710 to the end portion 130.

Figure 9:
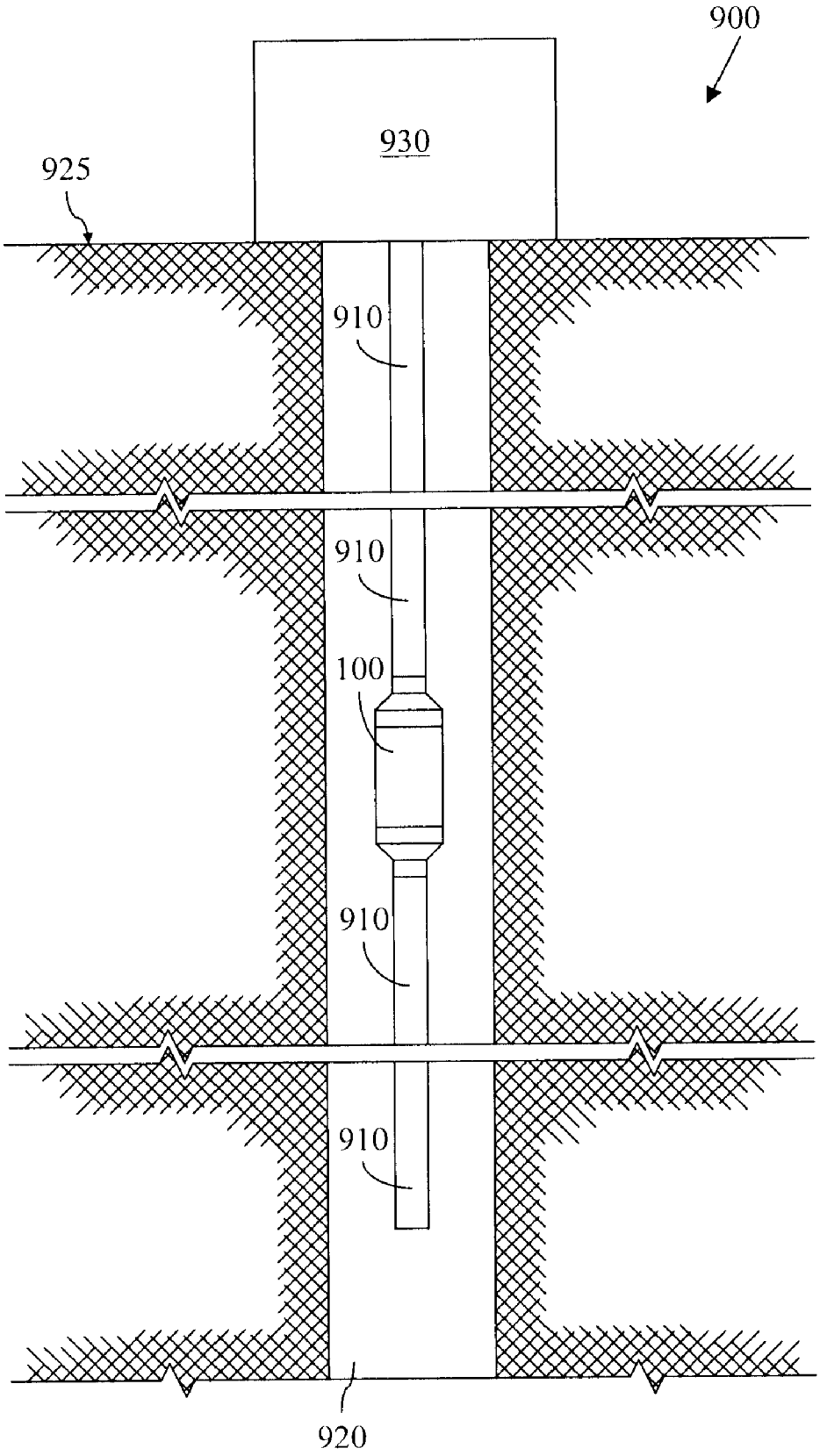
FIG. 9 is a side view of a system according to one or more aspects of the present disclosure.

FIG. 9 is a side view of a system 900 according to one or more aspects of the present disclosure. The system 900 demonstrates an environment in which the apparatus 100 of FIGS. 1-8 may be implemented. For example, the system 900 includes an embodiment of the apparatus 100 which may be substantially similar to at least one of those shown in FIGS. 1-8 or otherwise within the scope of the present disclosure. The apparatus 100 is assembled within a tubing string 910 which extends into a wellbore 920 from a lifting device 930 located at the surface 925 of the wellbore 920. The lifting device 930 may comprise a rig or mast having block equipment connecting the tubing string 910 to a drawworks device for raising an lowering the tubing string 910 within the wellbore 920. However, embodiments utilizing other lifting apparatus are also within the scope of the present disclosure.

As shown in FIG. 9, the apparatus 100 may be assembled within the tubing string 910 in an intermediate position, such that the apparatus is distal from both the surface 925 of the wellbore and the bottom end of the tubing string 910. However, the exact position of the apparatus 100 within the tubing string 910 may vary within the scope of the present disclosure. Moreover, in the embodiment shown in FIG. 9, the apparatus 100 is deployed as a single tool. However, other embodiments within the scope of the present disclosure may deploy multiple instances of the apparatus 100 positioned at critical points in the wellbore 920 at several points throughout the tubular string 910.

The system 900 shown in FIG. 9 may be utilized in implementations for completion, production, injection (e.g., disposal, water flood and enhanced oil recovery), fishing, workover, and stimulation (e.g., hydraulic fracture treatments, gravel packs, acidizing, and other downhole pumping operations). Data from the apparatus 100 may be used to calibrate tubular movement/force, torque, drag (friction), and/or shock models.

For example, in completions with "seal-bore" assemblies, excessive movement occurring as the result of injection or production operations can result in the tubing string 910 being pulled out of packer seals (not shown), which can result in a catastrophic completion failure. These tubular movements, or force changes, can be the result of pressure and/or temperature changes from injection or production operations. The strain, pressure and temperature information obtained by the apparatus 100 can be utilized to prevent destructive movement downhole.

Another example is for completion implementations utilizing Frac-Pack/Gravel Pack stimulations, wherein wash pipe may be deployed and the forces applied while pumping (injecting) can change. Consequently, subsequent pressure and temperature changes can force the tubing string 910 upward. If the movement is not properly accounted for, injection ports utilized for the stimulation may not line up, and the job may be aborted due to the inability to inject. However, by utilizing data obtained by the apparatus 100, it can be determined whether the inability to inject is a mechanical problem or a true "screen-out" of the stimulation (e.g., where proppant completely fills the void).

The system 900 may alternatively be a fishing system utilized to retrieve debris or equipment ("fish") from the wellbore 920. For example, the system 900 may be utilized to determine whether a fish or debris has been located and, subsequently, whether a fishing tool is engaging the fish in an attempt to secure the fish and bring it to the surface. During fishing, it can be difficult to determine when the fishing tools have come into contact with the fish. However, utilizing the apparatus 100 to monitor the forces and/or shock in the wellbore 920 can significantly help in these operations. This is particularly true for fishing in deep and/or deviated wells, and if the fish comprises delicate instruments. Utilizing the apparatus 100 to monitor stress, temperature and pressure within the wellbore 920, however, can make the fishing operation more efficient and minimize or even prevent damage to the equipment being fished.

In operation, the apparatus 100 may collect and store the stress, temperature and pressure data in the onboard memory device 180. Alternatively, or additionally, the apparatus 100 may be connected to equipment at the surface 925, such as for real-time readout and data storage. Telemetry to the surface 925 may be via electrical cable, fiber-optic cable, wireless telemetry and/or other telemetry systems.

The apparatus 100 may be utilized to provide direct measurement of the forces, shock, and/or movement (strain, torque, acceleration, pressure and/or temperature) acting on the tubing string 910, including at depth within the wellbore 920. Conventional methods involved estimations or mathematical models to determine such parameters, and were not sophisticated enough to accurately estimate the forces, shock, and/or movement present on the tubing string 910, especially for deep and/or deviated wellbores. However, utilization of the apparatus 100 or others within the scope of the present disclosure can allow direct measurement of forces, shock, and/or movement present on the tubing string 910 or sections thereof. This data can then be utilized to calibrate the mathematical models, greatly improving their usefulness.

The apparatus 100 may further allow optimization of the life and operation of the tubing string, whether it is a completion string, work string, production pipe string, or otherwise. The apparatus 100 may allow for both preventive and corrective actions for the completions, or production pipe program. For example, the apparatus 100 may allow simultaneously obtaining a combination of tension, compression, torque, acceleration, pressure and/or temperature measurements, with each measurements being selectable and configurable either through the population of the tool with the appropriate sensors or through the outputs of the sensors themselves.

The apparatus 100 may further be utilized to provide direct measurement of forces and/or movement acting on the tubing string 910, which may allow operational decisions to be made while on the job site. Such decisions may include, for example, changes to injection pressures, pump rates and fluids changes, forces acting on fishing tools at depth, and forces acting on jars, as well as determining slack off weight at depth for packer settings, or determining casing or string torque. Moreover, the value for these applications may be enhanced in embodiments in which real-time telemetry is employed.

In view of all of the above and FIGS. 1-9, it should be evident to those skilled in the art that the present disclosure introduces an apparatus for measuring forces acting on a tubing string within a wellbore. At least in one embodiment, the apparatus comprises a body including a central passage and at least one internal void radially offset from the central passage. First and second end portions extend axially from opposing first and second ends of the body, respectively, wherein each of the first and second end portions includes an internal passage aligned with the central passage of the body, and wherein each of the first and second end portions includes an interface configured to detachably couple to the tubing string for conveyance of the apparatus within the wellbore. A clamp is detachably coupled to the second end portion proximate the body, and a plurality of first sensors is coupled to the clamp and is configured to detect strain induced by forces acting on the tubing string. A plurality of second sensors is coupled to the body and is configured to detect pressure and temperature within an annulus-shaped region radially interposing the apparatus and the wellbore. A memory device is coupled to the body within the at least one internal void and is configured to log measurements detected by the plurality of first sensors and the plurality of second sensors. An electrical power supply is coupled to the body within the at least one internal void and is configured to provide electrical power to the memory device.

In an exemplary embodiment, the apparatus may further comprise a bonnet covering the clamp and the second end of the body and having a central aperture through which the second end portion extends. The bonnet may be a first bonnet and the central aperture may be a first central aperture, and the apparatus may further comprise a second bonnet covering the first end of the body and having a second central aperture through which the first end portion extends.

In an exemplary embodiment, the body and the first and second end portions may each be substantially cylindrical, and the body may have a substantially larger diameter relative to the first and second end portions. The first and second end portions may be integral to the body.

In an exemplary embodiment, the clamp may substantially encircle a perimeter of the second end portion. The clamp may have an outer diameter that is substantially smaller than an outer diameter of the body.

In an exemplary embodiment, the apparatus may further comprise at least one plug that fluidicly seals the at least one internal void and includes an electrical feed-through. The at least one internal void may comprise at least one aperture extending the entire length of the body, and the at least one plug may comprise a first plug that fluidicly seals the at least one aperture at the first end of the body and a second plug that fluidicly seals the at least one aperture at the second end of the body.

In an exemplary embodiment, the at least one internal void may include a memory device void and a power supply void, wherein the memory device is coupled within the memory device void and the electrical power supply is coupled within the power supply void. The memory device may be detachably coupled within the memory device void, and the electrical power supply may be detachably coupled within the power supply void. The memory device void and the power supply void may each be an aperture extending the entire length of the body, and the apparatus may further comprise: a first plug that fluidicly seals the power supply void at the second end of the body; a second plug that fluidicly seals the power supply void at the first end of the body and includes a first electrical feed-through; a third plug that fluidicly seals the memory device void at the first end of the body and includes a second electrical feed-through that is electrically connected to the first electrical feed-through; and a fourth plug that fluidicly seals the memory device void at the second end of the body and includes a third electrical feed-through that is electrically connected to the plurality of first sensors.

The present disclosure also introduces a method of monitoring forces acting on a tubing string within a wellbore. At least in one embodiment, the method comprises coupling a force measurement device to the tubing string, wherein the force measurement device includes: a plurality of first sensors configured to detect strain induced by forces acting on the tubing string; one or more second sensors configured to detect pressure and temperature within the wellbore proximate the force measurement device; and a memory device configured to log measurements detected by the first and second sensors. The method further comprises conveying the force measurement device into the wellbore, detecting with the first sensors the strain induced by forces acting on the tubing string, and detecting with the one or more second sensors the pressure and temperature within the wellbore proximate the force measurement device. The detected strain, pressure and temperature is then stored in the memory device.

In an exemplary embodiment, the method may further comprise transmitting the stored strain, pressure and temperature measurements from the force measurement device via telemetry. The method may further comprise performing completion of the wellbore, performing an injection operation within the wellbore, performing a fishing operation within the wellbore, or performing production from the wellbore, while detecting and storing the strain, pressure and temperature. The method may further comprise removing the force measurement device from the wellbore, detaching the force measurement device from the tubing string, and subsequently accessing the detected strain, pressure and temperature data stored in the memory device while the force measurement device is detached from the tubing string.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus for measuring forces acting on a tubing string within a wellbore, comprising:

a body including a central passage and at least one internal void radially offset from the central passage;

first and second end portions extending axially from opposing first and second ends of the body, respectively, wherein each of the first and second end portions includes an internal passage aligned with the central passage of the body, and wherein each of the first and second end portions includes an interface configured to detachably couple to the tubing string for conveyance of the apparatus within the wellbore;

a clamp detachably coupled to the second end portion proximate the body;

a plurality of first sensors coupled to the clamp and configured to detect strain induced by forces acting on the tubing string;

at least one second sensor coupled to the body and configured to detect pressure and temperature within an annulus-shaped region radially interposing the apparatus and the wellbore;

a memory device coupled to the body within the at least one internal void and configured to log measurements detected by the first and second sensors; and an electrical power supply coupled to the body within the at least one internal void and configured to provide electrical power to the memory device.

2. The apparatus of claim 1 further comprising a bonnet covering the clamp and the second end of the body and having a central aperture through which the second end portion extends.

3. The apparatus of claim 2 wherein the bonnet is a first bonnet and the central aperture is a first central aperture, and wherein the apparatus further comprises a second bonnet covering the first end of the body and having a second central aperture through which the first end portion extends.

4. The apparatus of claim 1 wherein body and the first and second end portions are each substantially cylindrical, and wherein the body has a substantially larger diameter relative to the first and second end portions.

5. The apparatus of claim 1 wherein the first and second end portions are integral to the body.

6. The apparatus of claim 1 wherein the clamp substantially encircles a perimeter of the second end portion.

7. The apparatus of claim 6 wherein the clamp has an outer diameter that is substantially smaller than an outer diameter of the body.

8. The apparatus of claim 1 further comprising at least one plug that fluidicly seals the at least one internal void and includes an electrical feed-through.

9. The apparatus of claim 8 wherein the at least one internal void comprises at least one aperture extending the entire length of the body, and wherein the at least one plug comprises a first plug that fluidicly seals the at least one aperture at the first end of the body and a second plug that fluidicly seals the at least one aperture at the second end of the body.

10. The apparatus of claim 1 wherein:

the at least one internal void includes a first void and a second void;

the memory device includes a first memory device and a second memory device;

the electrical power supply includes a first power supply and a second power supply;

the first sensors, the first memory device and the first power supply are interconnected and coupled within the first void; and the one or more second sensors, the second memory device and the second power supply are interconnected and coupled within the second void.

11. The apparatus of claim 10 further comprising a first plug that is detachably coupled to a first end of the first void and a second plug that is detachably coupled to a first end of the second void, wherein the first and second plugs each include an electrical feed-through.

12. The apparatus of claim 11 wherein the first and second voids are each an aperture extending the entire length of the body, and wherein the apparatus further comprises:

a third plug that fluidicly seals a second end of the first void; and a fourth plug that fluidicly seals a second end of the second void.

13. An apparatus for measuring forces acting on a tubing string within a wellbore, comprising:

a substantially cylindrical body including a central passage and first and second voids each radially offset from the central passage, wherein the central passage and the first and second voids are each an aperture extending the entire length of the body;

first and second substantially cylindrical end portions integral to the body and extending axially from opposing first and second ends of the body, respectively, wherein each of the first and second end portions includes an internal passage aligned with the central passage of the body, wherein the first and second end portions are substantially smaller in diameter relative to the body, and wherein each of the first and second end portions includes an interface configured to detachably couple to the tubing string for conveyance of the apparatus within the wellbore;

a clamp detachably coupled to the second end portion proximate the body and thereby substantially encircling a perimeter of the second end portion, wherein an outer diameter of the clamp is substantially smaller than an outer diameter of the body;

a plurality of first sensors coupled to the clamp and configured to detect strain induced in the body by forces acting on the tubing string;

at least one second sensor coupled to the body and configured to detect pressure and temperature within an annulus-shaped region radially interposing the apparatus and the wellbore;

a memory device detachably coupled to the body within the first void and configured to log measurements detected by the first and second sensors;

an electrical power supply detachably coupled to the body within the second void and configured to provide electrical power to the memory device;

a first bonnet covering the first end of the body and having a first central aperture through which the first end portion extends;

a second bonnet covering the clamp and the second end of the body and having a second central aperture through which the second end portion extends;

a first plug that fluidicly seals the second void at the second end of the body;

a second plug that fluidicly seals the second void at the first end of the body and includes a first electrical feedthrough;

a third plug that fluidicly seals the first void at the first end of the body and includes a second electrical feedthrough; and a fourth plug that fluidicly seals the first void at the second end of the body and includes a third electrical feedthrough that is electrically connected to the plurality of first sensors.

14. A method of monitoring forces acting on a tubing string within a wellbore, comprising:

coupling a force measurement device to the tubing string, wherein the force measurement device includes:

a clamp detachably connected to an end portion extending axially from a body of the measurement device;

a plurality of first sensors coupled to the clamp and configured to detect strain induced by forces acting on the tubing string;

at least one second sensor configured to detect pressure and temperature within the wellbore proximate the force measurement device; and a memory device configured to log measurements detected by the first and second sensors;

conveying the force measurement device into the wellbore;

detecting with the first sensors the strain induced by forces acting on the tubing string;

detecting with the at least one second sensor the pressure and temperature within the wellbore proximate the force measurement device; and storing, in the memory device, the detected strain, pressure and temperature.

15. The method of claim 14 further comprising transmitting the stored strain, pressure and temperature measurements from the force measurement device via telemetry.

16. The method of claim 14 further comprising performing completion of the wellbore while detecting and storing the strain, pressure and temperature.

17. The method of claim 14 further comprising performing an injection operation within the wellbore while detecting and storing the strain, pressure and temperature.

18. The method of claim 14 further comprising performing a fishing operation within the wellbore while detecting and storing the strain, pressure and temperature.

19. The method of claim 14 further comprising performing production from the wellbore while detecting and storing the strain, pressure and temperature.

20. The method of claim 14 further comprising removing the force measurement device from the wellbore, detaching the force measurement device from the tubing string, and subsequently accessing the detected strain, pressure and temperature data stored in the memory device while the force measurement device is detached from the tubing string.

* * * * *